US006901679B2

(12) United States Patent
Corbett et al.

(10) Patent No.: US 6,901,679 B2
(45) Date of Patent: Jun. 7, 2005

(54) SPRINKLER SPACER SYSTEM

(75) Inventors: Joseph Craig Corbett, P.O. Box 957, Lyman, WY (US) 82937; George B. Bersonnet, Providence, UT (US); Harvey L. Mohr, Providence, UT (US); Kevin H. Mohr, Providence, UT (US); Natalie H. Corbett, Tremonton, UT (US)

(73) Assignee: Joseph Craig Corbett, Mountain View, WY (US)

( * ) Notice: Subject to any disclaimer, the term of this patent is extended or adjusted under 35 U.S.C. 154(b) by 0 days.

(21) Appl. No.: 10/696,931

(22) Filed: Oct. 30, 2003

(65) Prior Publication Data

US 2004/0089739 A1 May 13, 2004

Related U.S. Application Data

(60) Provisional application No. 60/423,783, filed on Nov. 5, 2002.

(51) Int. Cl.[7] ..... B05B 15/06

(52) U.S. Cl. ..... 33/624; 33/1 H; 33/645; 239/273

(58) Field of Search ..... 33/1 G, 1 H, 613, 33/645, 529, 624; 239/200, 201, 273, 276, 288; 173/20, 21, 126; 116/209

(56) References Cited

U.S. PATENT DOCUMENTS

| | | | | | |
|---|---|---|---|---|---|
| 1,531,912 | A | * | 3/1925 | Farmer | 239/240 |
| 2,080,341 | A | * | 5/1937 | Schumacher | 239/201 |
| 2,197,278 | A | * | 4/1940 | Sverdahl | 33/501 |
| 2,846,189 | A | * | 8/1958 | MacLaughlin | 242/615.2 |
| 3,967,381 | A | * | 7/1976 | Chesbro | 33/1 H |
| 4,146,181 | A | * | 3/1979 | Soos | 239/288.5 |
| 4,334,661 | A | * | 6/1982 | Pitt | 248/146 |
| 4,583,482 | A | * | 4/1986 | Smith | 116/209 |
| 4,924,579 | A | * | 5/1990 | Berendsen | 33/1 LE |
| 4,944,476 | A | * | 7/1990 | Olson | 248/87 |
| 5,678,353 | A | * | 10/1997 | Tsao et al. | 47/32 |
| 5,699,864 | A | * | 12/1997 | Dvorak et al. | 173/91 |
| D410,731 | S | * | 6/1999 | Bowman et al. | D23/227 |
| 6,186,416 | B1 | * | 2/2001 | Jones | 239/288.5 |
| 6,502,349 | B1 | * | 1/2003 | Richet et al. | 47/33 |
| 6,575,380 | B2 | * | 6/2003 | Corbett | 239/1 |
| 6,581,531 | B2 | * | 6/2003 | Sawers et al. | 111/106 |
| 2004/0065753 | A1 | * | 4/2004 | Corbett | 239/273 |
| 2004/0154812 | A1 | * | 8/2004 | McDonald | 173/90 |
| 2004/0164179 | A1 | * | 8/2004 | Corbett | 239/276 |

* cited by examiner

*Primary Examiner*—R. Alexander Smith
(74) *Attorney, Agent, or Firm*—Dean P. Edmundson

(57) ABSTRACT

A spacer system for attachment to a sprinkler to prevent the positioning of the sprinkler too close to a sidewalk or curb, etc., including a spacer which can be attached to the sprinkler, and an elongated stake having a notch for receiving and holding the spacer. Also described is a tool for use in installing the stake in the ground.

6 Claims, 3 Drawing Sheets

SPRINKLER SPACER SYSTEM

CROSS-REFERENCE TO RELATED APPLICATIONS

This application is related to application Ser. No. 10/626,910, filed Jul. 25, 2003 and application Ser. No. 10/674,222, filed Sep. 29, 2003. This application is also related to, and claims the benefit of, our Provisional Application No. 60/423,783, filed Nov. 5, 2002. This application is also related to issued U.S. Pat. No. 6,575,380.

FIELD OF THE INVENTION

This invention relates to sprinkler systems commonly used for sprinkling lawns or other landscaped areas. More particularly, it relates to installation techniques for sprinkler systems and to spacer guides for positioning sprinkler heads.

BACKGROUND OF THE INVENTION

Typical sprinkler systems used for lawns and other landscaped areas include water supply lines which are placed below ground and extend from a main supply pipe to each sprinkler head. The sprinkler head extends upwardly to the upper surface of the ground. Typical sprinkler heads are of the "pop-up" style which extend upwardly above the grass when pressure is applied to the water in the supply line, and then the sprinkler head retracts when it is no longer in use. The top of the sprinkler head remains exposed at ground level.

In some installations, the sprinkler head is connected to the water supply pipe with a flexible pipe. Although this enables the installer to more easily position the sprinkler head in a desired place, the flexible pipe provides little, if any, support to the sprinkler head (either lateral or vertical support). As a result, when soil is filled in around the sprinkler head, the sprinkler head can tilt to one side or the other, and the sprinkler head can also sink downwardly. When the sprinkler head is too close to a sidewalk or curb, etc., the spinning metal blade of an edger can irreparably damage any sprinkler head which is too close to the sidewalk, curb, etc. Then the sprinkler head must be replaced, at considerable time and expense.

U.S. Pat. Nos. 4,146,181 (Soos), 5,678,353 (Tsao), 6,186,416 (Jones) and D410,731 (Bowman et al.) describe various types of sprinkler head guards, grass guards, and mats for use on or around sprinkler heads. However, there has not heretofore been provided a sprinkler spacer and installation technique of the type described herein.

SUMMARY OF THE INVENTION

In accordance with one embodiment of the invention, there is provided a sprinkler head spacer system for attachment to the body of a water sprinkler to prevent the positioning of the sprinkler too close to a sidewalk or curb, the spacer system comprising:

(a) a spacer member having first and second lateral edges, and including attachment means for attaching the spacer member to the sprinkler; and (b) an elongated stake member having upper and lower ends and a notch below the upper end; wherein the notch is of a size suitable for receiving and holding the spacer member a predetermined distance from the surface of the ground.

In accordance with another embodiment of the invention, there is provided a tool for positioning an elongated support stake a predetermined distance from a sidewalk, curb, etc.

The tool preferably comprises upper and lower portions; wherein the upper portion includes a handle and a laterally extending depth gauge. The lower portion is adapted to engage the upper end of the stake, and the lower portion is sized such that it provides a predetermined distance between the stake and the sidewalk, curb, etc.

BRIEF DESCRIPTION OF THE DRAWINGS

The invention is described in more detail hereinafter with reference to the accompanying drawings.

DETAILED DESCRIPTION OF THE INVENTION

Figure 1:
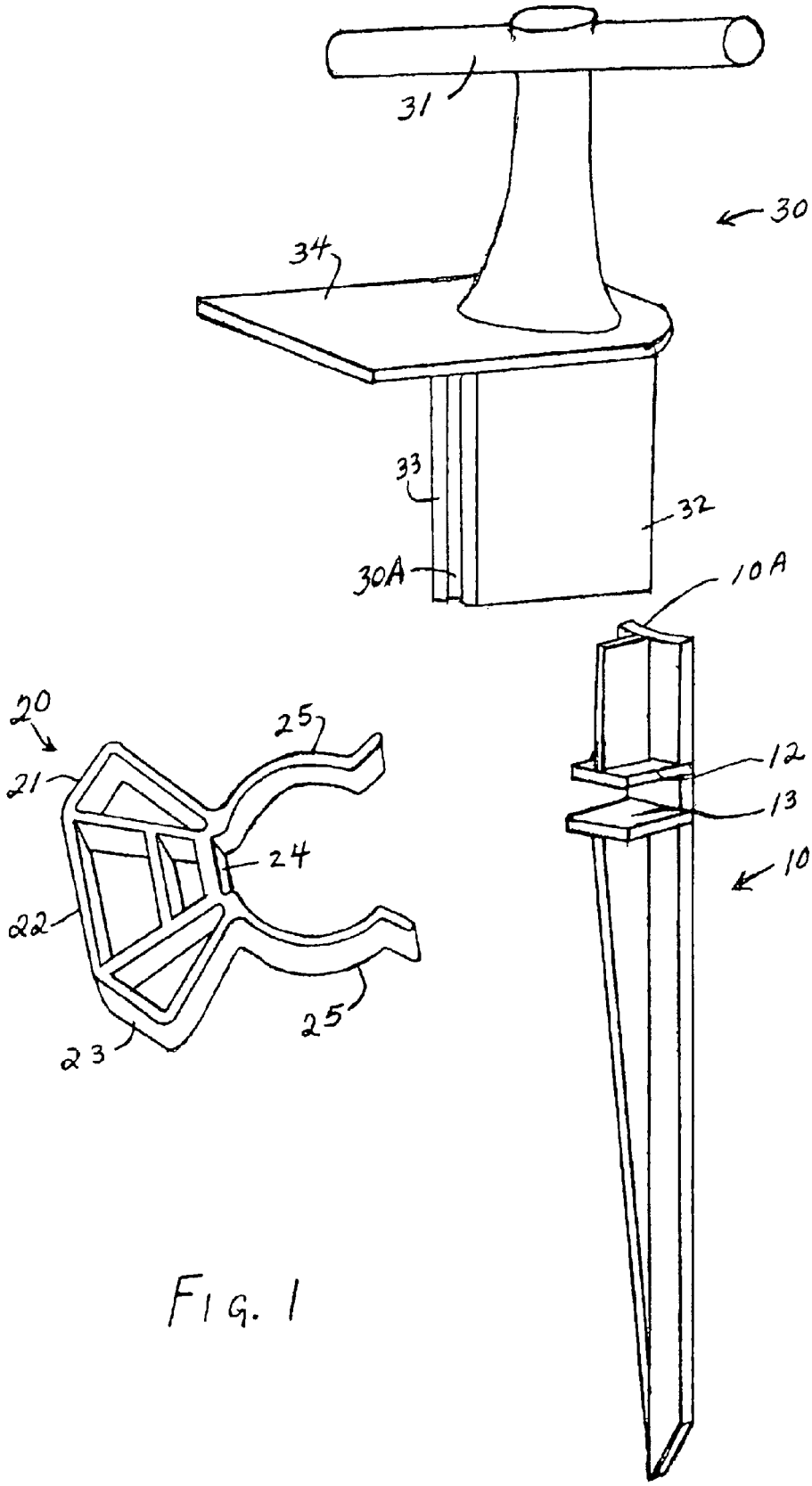
FIG. 1 is a perspective view illustrating one embodiment of an elongated stake, a sprinkler spacer, and an installation tool useful in this invention.

FIG. 1 is an exploded view showing an elongated stake member 10, a sprinkler spacer 20, and a tool 30 useful for inserting the stake into the ground. The stake is preferably tapered at its lower end to facilitate insertion into the ground. The stake includes a notch or recess 11 near its upper end which is sized to slidably receive the sprinkler spacer 20. The notch may be located, for example, about 1 to 1.5 inches below the upper end of the stake.

Preferably the notch or recess in the stake is defined by spaced-apart, parallel plates 12 and 13, as shown, which are perpendicular to the longitudinal axis of the stake. The distance between these two plates is slightly greater than the thickness of the spacer 20 so that the spacer can slide between the plates 12 and 13 and will be securely held there during use. The rear face or side 10A of the stake may be slightly concave, if desired, in order to more closely fit against the side wall of the cylindrical body of a sprinkler.

The sprinkler spacer 20 includes outer peripheral edges 21, 22 and 23 as well as an inner edge 24 and opposing spring finger clips 25 for attaching the spacer to a sprinkler body. The spacer is intended to be slidably received in the notch or recess between the plates 12 and 13 of the stake, with edge 24 of the spacer being against the stake. The spacer is accordingly securely held in place between plates 12 and 13 on the stake. One or more of the outer peripheral edges of the spacer are intended to contact the edge of a sidewalk, curb, etc. so as to prevent the sprinkler from being positioned too close to the sidewalk or curb. Preferably the spacer includes vertical openings through it to enable water and fertilizer to flow through.

Also shown in FIG. 1 is a tool 30 which is useful for (a) inserting the stake into the ground, and (b) positioning the stake a predetermined distance from a sidewalk, curb, etc. and also assuring that the sprinkler spacer 20 will be positioned a predetermined distance below the upper surface of the sidewalk, curb, etc. and the sod to be laid later.

The lower portion of the tool preferably includes a slot 30A (defined between vertical spaced-apart plates 32 and 33) for receiving the upper end of the stake. The lower portion also has a width which prevents the stake from being positioned too close to the sidewalk, curb, etc. For convenience in use, the tool preferably includes a handle 31 on its upper portion. The lower portion of the tool is positioned on the upper end of the stake, with the width of the lower portion determining the distance that the stake will be located away from the edge of the sidewalk, curb, etc. Then the stake can be pushed into the ground by applying downward pressure to the handle (or by using a hammer to tap on the top of the handle). When the horizontally disposed depth gauge 34 on the tool contacts the upper surface of the sidewalk, curb, etc. the stake is at the proper height for attachment of the sprinkler spacer in the notch on the stake. This assures that the head of a sprinkler to be installed will be positioned a sufficient distance away from the edge of the sidewalk, curb, etc. so that the head will not be contacted by the spinning metal blade of an edger.

Figure 2:
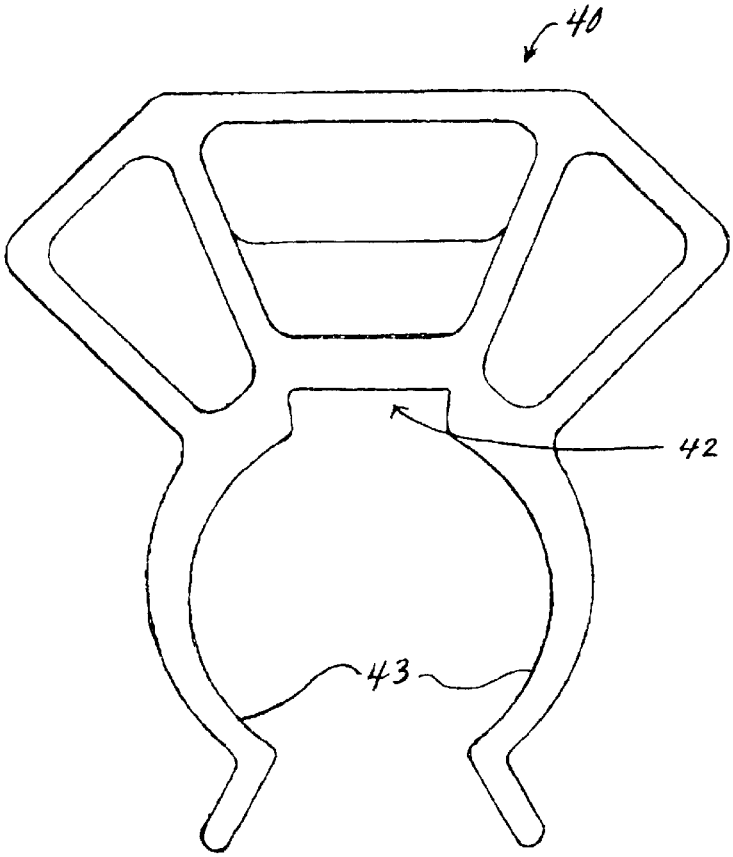
FIG. 2 is a top view of one embodiment of sprinkler spacer member useful in this invention.
Figure 3:
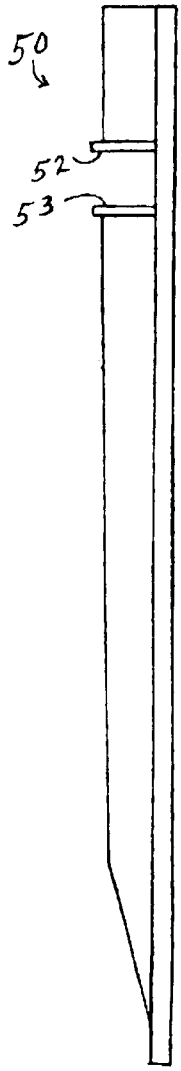
FIG. 3 is a side view of another embodiment of stake member useful in this invention.

FIG. 2 is a top plan view of another embodiment of spacer 40 which includes a notch 42 in its inner side for accommodating a stake member (e.g. of FIG. 3). The spacer also includes resilient finger clips 43 for engaging a sprinkler body. FIG. 3 is a side elevational view of one embodiment of stake member 50 having a notch or recess near its upper end defined by parallel plates 52 and 53. A spacer of the type shown in FIG. 2 can be inserted between the plates and held in place on the stake so that the spacer is perpendicular to the stake.

Figure 4:
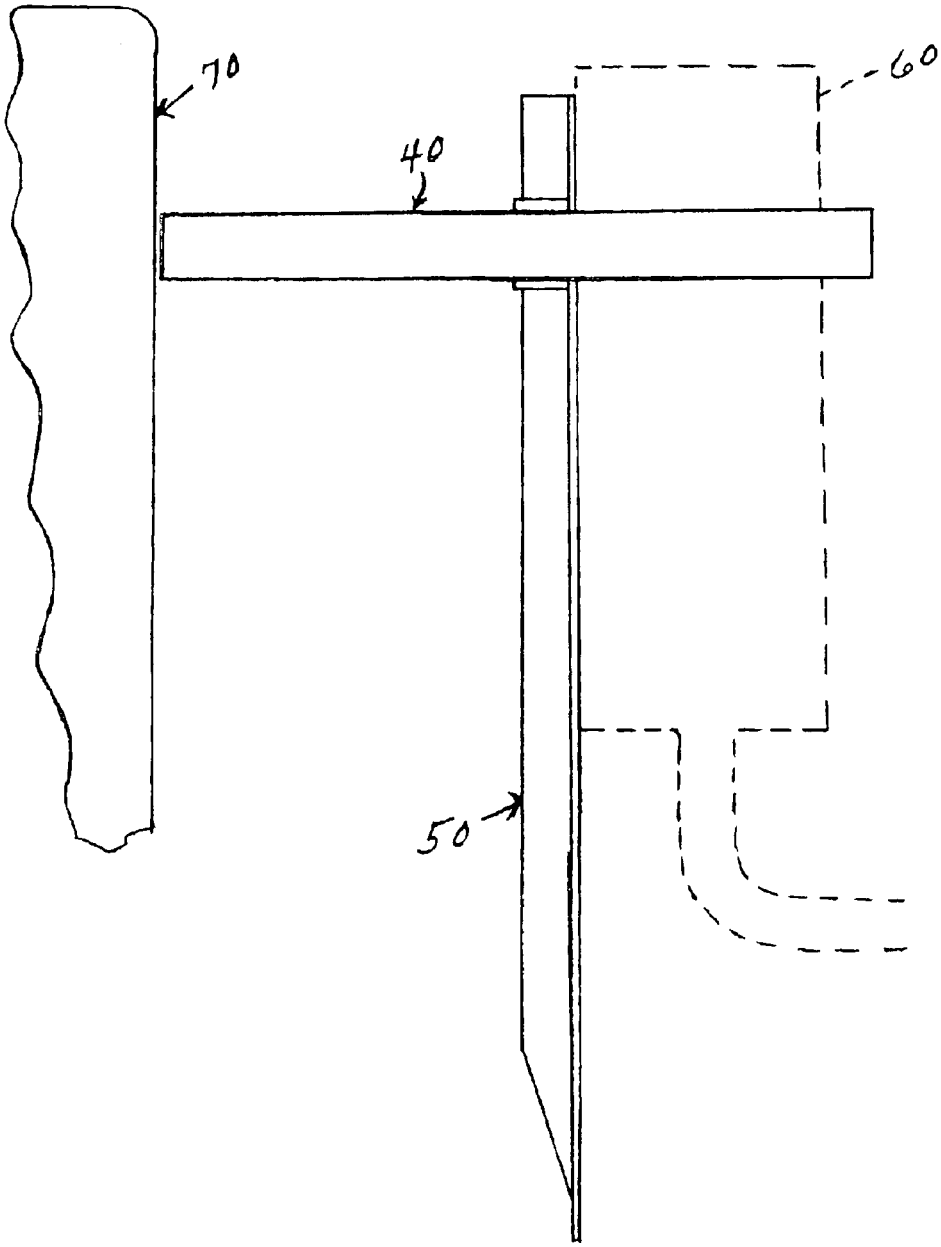
FIG. 4 is an elevational view showing a stake member, sprinkler, spacer and the edge of a sidewalk or curb.

FIG. 4 is an elevational view illustrating the positions of a sprinkler 60, stake 50 and sprinkler spacer 40 relative to the edge of a sidewalk or curb 70 after installation. The stake and spacer support the sprinkler in the ground both vertically and laterally relative to the sidewalk or curb. The spacer is located sufficiently below the upper surface of the sidewalk and the top of the sprinkler that it will not be contacted by the metal blade of an edger. Also, the spacer prevents the sprinkler from drifting or tilting toward the sidewalk or curb anytime after installation.

Other variants are possible without departing from the scope of this invention. For example, the length of the stake and the shape of the taper may vary, as desired.

What is claimed is:

1. A sprinkler head spacer system for attachment to the body of a water sprinkler to prevent the positioning of the sprinkler too close to a sidewalk or curb, the spacer system comprising:

(a) a spacer member having first and second lateral edges, and including attachment means for attaching said spacer member to said sprinkler; and (b) an elongated stake member having upper and lower ends and a notch below said upper end; wherein said notch is defined by spaced-apart, parallel plates on said stake member; wherein said plates are perpendicular to the longitudinal axis of said stake member; wherein said notch is of a size suitable for receiving and holding said spacer member.

2. A system in accordance with claim 1, wherein said attachment means comprises a pair of opposing spring clips for gripping said sprinkler.

3. A system in accordance with claim 1, wherein said attachment means extends laterally outward from said second lateral edge of said spacer member.

4. A system in accordance with claim 1, wherein said spacer member includes a recessed area for receiving said stake member.

5. A tool for positioning an elongated support stake a predetermined distance from a sidewalk, curb, etc., the tool comprising upper and lower portions; wherein said upper portion includes a handle and a laterally extending depth gauge; wherein said lower portion is adapted to engage the upper end of said stake; wherein said lower portion is sized such that it is a guage for gauging said predetermined distance between said stake and said sidewalk, curb, etc.

6. A method for installing a sprinkler a predetermined distance from a sidewalk, curb, etc. comprising the steps of:

(a) positioning an elongated stake in the ground a predetermined distance from said sidewalk, curb, etc., wherein said stake includes a notch intermediate its ends; wherein said notch is defined by spaced-apart, parallel plates on said stake; wherein said plates are perpendicular to the longitudinal axis of said stake;

(b) inserting a sprinkler spacer in said notch of said stake where said spacer is held and supported between said stake and said sidewalk or curb; wherein said spacer includes opposing resilient spring clips for gripping said sprinkler; and (c) attaching said sprinkler to said spacer by means of said spring clips;

wherein said predetermined distance is determined by said sprinkler spacer.

* * * * *